US007331272B2

(12) United States Patent
Forster

(10) Patent No.: US 7,331,272 B2
(45) Date of Patent: Feb. 19, 2008

(54) MULTIPLE-STROKE HYDROSTATIC AXIAL PISTON MACHINE

(75) Inventor: Franz Forster, Karlstadt-Mühlbach (DE)

(73) Assignee: Linde Material Handling GmbH, Aschaffenburg (DE)

( * ) Notice: Subject to any disclaimer, the term of this patent is extended or adjusted under 35 U.S.C. 154(b) by 0 days.

(21) Appl. No.: 11/361,712

(22) Filed: Feb. 24, 2006

(65) Prior Publication Data

US 2006/0201323 A1 Sep. 14, 2006

(30) Foreign Application Priority Data

Feb. 26, 2005 (DE) ..... 10 2005 008 845
Dec. 7, 2005 (DE) ..... 10 2005 058 323

(51) Int. Cl.
*F04B 1/20* (2006.01)
*F04B 53/00* (2006.01)

(52) U.S. Cl. ..... 92/57; 92/71; 74/56

(58) Field of Classification Search ..... 91/499; 92/57, 71; 74/56
See application file for complete search history.

(56) References Cited

U.S. PATENT DOCUMENTS 3,274,896 A * 9/1966 Terho ..... 91/499
3,599,536 A * 8/1971 Myers ..... 91/502
4,598,627 A * 7/1986 Brisland ..... 91/499
4,610,195 A 9/1986 Cunningham et al.
4,756,239 A * 7/1988 Hattori et al. ..... 92/71
6,938,590 B2 * 9/2005 Buelna ..... 92/71

FOREIGN PATENT DOCUMENTS

DE 34 31 328 1/1986

* cited by examiner

*Primary Examiner*—Thomas E. Lazo
(74) *Attorney, Agent, or Firm*—The Webb Law Firm

(57) ABSTRACT

A multiple-stroke hydrostatic axial piston machine has a plurality of piston-shaped displacement bodies (13) that can each move longitudinally in a displacement chamber (12) and are each supported by a roller body on a track (9) that is provided with axial cams (10) that generate a reciprocal motion. Each of the roller bodies is a roller (14) which is located in a recess (A) of the displacement body (13) that restricts radial and axial relative movements of the roller (14) with respect to the displacement body (13). The displacement body (13) can be configured as a cage of the roller (14).

26 Claims, 8 Drawing Sheets

MULTIPLE-STROKE HYDROSTATIC AXIAL PISTON MACHINE

CROSS-REFERENCE TO RELATED APPLICATIONS

This application claims priority to German Application No. 10 2005 008 845.7 filed Feb. 26, 2005, and German Application No. 10 2005 058 323.7 filed Dec. 7, 2005, both of which applications are herein incorporated by reference in their entirety.

BACKGROUND OF THE INVENTION

1. Field of the Invention

This invention relates to a multiple-stroke hydrostatic axial piston machine with a plurality of piston-shaped displacement bodies, each of which can move longitudinally in a displacement chamber and is supported by a roller body on a track provided with the stroke-generating axial cam.

2. Technical Considerations

An axial piston machine of the general type described above is disclosed in DE 34 31 328 A1. This axial piston machine has spherical roller bodies, by means of which the displacement bodies, which are in the form of pistons, are supported in a groove-shaped track. This type of machine is, therefore, conventionally called a "spherical piston machine". The axial piston machine of the known art utilizes a swashplate construction. In this case, the displacement chambers and the longitudinally movable displacement bodies located in them are in a rotating cylinder drum of a rotor assembly, while the track is associated with the load-independent periodic stroke function of a stator assembly.

An object of the present invention is to provide a multiple-stroke hydrostatic axial piston machine of the general type described above, but which has a simple construction, an increased output, and an expanded range of potential applications.

SUMMARY OF THE INVENTION

The invention provides an axial piston machine in which each roller body is a roller, which is in a recess of the displacement body that restricts the radial and axial relative movements of the roller relative to the displacement body, with the displacement body in the form of a cage for the roller.

In place of a sphere that rolls in a groove-shaped ball bearing race, a roller that can withstand a significantly higher load is used as the roller body, which rolls on a track that is flat in the axial direction of the roller. In this case, the displacement body is used as the roller cage which, in relation to the axis of rotation of the roller, guides the roller both radially and axially and, in particular, prevents the roller from executing radially outward excursions (with reference to the axis of rotation of the machine).

In contrast to spherical roller bodies, which make possible only an area of contact with the track that is either a single spot or circular, the roller of the present invention, on account of the linear to elliptical contact area with the track, can support a higher load. This means that the axial piston machine of the invention can be operated at significantly higher pressures than a spherical piston machine. The axial piston machine of the invention therefore has an increased output capacity, which significantly expands its range of potential applications.

In one preferred configuration of the invention, the roller is a cylindrical or barrel roller. In this case, a certain amount of slipping between the roller and the track is tolerated, which at a constant angular velocity results from the different peripheral velocities along the roller. Nevertheless, it is also possible to realize the roller in the form of a tapered or conical roller.

As the displacement body, a smooth piston can be used, i.e., a cylindrical body (solid or hollow piston), in whose end surface facing the track the roller is embedded. In this case, however, the surface area (e.g., rectangular) that is available for the transmission of axial force from the displacement body to the roller is smaller than the surface (e.g., circular) that is provided for the transmission of the hydraulically-generated axial force that is exerted on the inner end surface of the piston. With such a realization of the axial piston machine of the invention, the range of potential applications is, therefore, primarily in the medium-pressure range, i.e., in the range of approximately 200 to 300 bar.

However, if the displacement body has a first piston segment that holds the roller, and a second, smaller-diameter piston segment that is exposed to the hydraulic pressure, it is possible to equalize or match the force-transmitting surfaces and, thus, reduce the load on the roller. In that case, the objective is to configure the "inner" end surface of the displacement body, which is subjected to the hydraulic pressure, and the "outer" end surface of the displacement body, which faces the track and acts as the bearing surface for the roller, so that they are equal in area.

The two piston segments of the displacement body are advantageously located one directly behind the other. Therefore, the piston in question is a differential or step piston that is easy to manufacture.

In a first embodiment, the first piston segment is located outside the displacement chamber. The first piston segment is, therefore, in the open, i.e., not inside any enclosure, and there is space for an increase in its diameter and, thus, for a larger roller. In this embodiment, however, the transverse forces that act on the displacement body as a result of the support on the track via the roller can be absorbed by the second piston segment that is located inside the displacement chamber, whereby there is both a surface pressure as well as a significant bending load on the displacement body.

In a second embodiment, it is particularly advantageous if the first piston segment is located in a first boring segment of the associated displacement chamber provided for the absorption of transverse forces, and the second piston segment projects into a second boring segment of the displacement chamber that contains hydraulic fluid. In this case, the first piston segment absorbs primarily transverse forces but is not required to perform any sealing function. On the other hand, the second piston segment that moves longitudinally in a sealed manner in the associated second boring segment is subjected only to longitudinal forces and low transverse forces. On account of the larger diameter of the first piston segment and of the associated first boring segment, the surface pressures caused in this area by the transverse forces are reduced, or vice versa, at a constant surface pressure. The cam angle (steepness of the axial cams in the peripheral direction) and, thus, the stroke volume are increased, which increases the output capacity of the axial piston machine.

In this embodiment, it is advantageous if the first boring segment of the chamber is connected to an air vent. The operating pressure is, therefore, present only in the second boring segment of the displacement chamber.

In one advantageous configuration of the invention, the axis of rotation of the roller, at least when the camshaft of the axial cams sweeps over it, is inside the first boring segment of the displacement chamber. The displacement body is then largely free of bending forces because the transverse forces are still directed largely inside the first boring segment of the displacement chamber. This arrangement can also be utilized to increase the output of the axial piston machine.

In one advantageous development of the invention, a pressure device that is independent of the operating pressure is provided to generate a force that pushes the displacement body toward the track and keeps the roller in effective engagement with the track. The pressure device ensures that the displacement body plus the roller does not lift up away from the track. At the same time, it also acts as an anti-twist protection device, which prevents the displacement body with the roller from twisting at a right angle to the axial cams of the track. The displacement body is, therefore, centered in the displacement chamber by the pressure device by means of the roller, which is always in contact with the track and by the geometry of the track.

The pressure device can have a compression spring that acts directly or indirectly on the displacement body. The effort and expense involved in the manufacture of the pressure device is, therefore, low.

If the design does not include a pressure device or if a pressure device is present but fails, it is advantageous if there is a securing device that limits the rotation of the displacement body relative to the displacement chamber.

A number of different configurations are possible for a securing device of this type. In one of these configurations, the securing device has a radial pin, which projects into an axial groove that is machined on the outside periphery of the displacement body.

In one embodiment of the displacement body in the form of a step piston, the axial groove can be provided on the first piston segment of the displacement body. Nevertheless, it is also possible to provide the axial groove on the second piston segment, which projects into the second boring segment of the displacement chamber, which second boring segment is exposed to the operating pressure.

A control device is also conceivable in which an axial pin that is located eccentrically with respect to the center axis of the second piston segment projects into the end surface of the second piston segment, which end surface is under pressure.

A securing device to limit the rotation of the displacement body relative to the displacement chamber can also be achieved if the second piston segment has an offset relative to the first piston segment ("eccentric step piston"). A rotation of the displacement body in the complementary displacement chamber is, therefore, not possible.

In one configuration of the displacement body in which the first piston segment extends into the open or outside the housing, the first piston segment can have contact areas in the peripheral direction that are engaged with contact areas of the first piston segments of the neighboring displacement bodies and interact with one another as a securing device to limit a rotation of the displacement body relative to the displacement chamber. In this case, the first piston segments are in a circular shape and prevent each other from twisting.

If, in the axial piston machine of the invention, the track is provided on a stator assembly and the displacement chambers are located in a cylinder drum of a rotor assembly, which cylinder drum is in axial contact against a control surface of the stator assembly that is permanently attached to the housing, the resulting construction can utilize the swashplate principle.

In combination with the use of displacement bodies with piston segments (e.g., eccentric) that are offset with respect to one another, it is advantageous if the second piston segment and the second boring segment are offset radially inwardly with respect to the first piston segment and the first boring segment, respectively, in relation to the axis of rotation of the cylinder drum. The result is a greater external wall thickness of the boring segment of the displacement chamber that is under operating pressure.

A brake can be located radially between the cylinder drum and a surrounding machine housing. When the axial piston machine is used as a motor, for example as a wheel motor, the brake can be used to decelerate the vehicle that is equipped with the axial piston machine.

In one exemplary embodiment of the axial piston machine of the invention in which the track is provided on an eccentric disc of a rotor assembly and the displacement chambers are provided in a machine housing of a stator assembly, the result is theoretically a wobble plate construction in which the eccentric disc rotates.

In this case, it is advantageous to provide a disc cam that rotates synchronously with a drive shaft of the rotor assembly. The disc cam is located so that it can move axially in a disc cam receptacle that is connected with the drive shaft and is in contact against a surface of the stator assembly.

A brake can be located radially between the disc cam receptacle and the machine housing.

Alternatively, it is also possible to locate a brake radially between the drive shaft and the machine housing.

The power that can be transmitted by the axial piston machine of the invention can require high braking moments or torques, in particular from brakes that are located on a relatively small diameter. With the disc brakes (e.g., wet disc brakes) that are generally used, the braking torque that can be applied is a function of the number of brake discs. Above a certain number of discs, e.g., 8-10, the braking torque no longer increases proportionally with the actuation force that is required to compress the discs.

To be able to apply a high braking torque, it is therefore advantageous on the axial piston machine of the invention if, independently of the physical location of the brake and the braking principle of the axial piston machine, the brake is a disc brake, in particular a spring-loaded disc brake, and includes at least two independent brake groups.

If the rotor assembly has a differential transmission, the axial piston machine of the invention can be integrated directly into a drive shaft, which expands the range of potential applications of this powerful and efficient machine.

It is also advantageous if the rotor assembly is coupled in rotational synchronization with the rotor assembly of a second axial piston machine that incorporates a swashplate construction, the stroke volume of which is adjustable and which is connected hydraulically in parallel. Consequently, the delivery and intake volumes of the two axial piston machines can be added to or subtracted from one another, for example to change the output speed when the axial piston machine is used as a motor unit. As a result of the secondary regulation that thereby becomes possible, the delivery volume of a pump that feeds the motor can be reduced.

With regard to compact dimensions and simple construction, in one advantageous development, the eccentric discs of the two axial piston machines that form a single module are located on the opposite ends of the module. A common control flange is located between the two axial piston machines.

BRIEF DESCRIPTION OF THE DRAWINGS

Additional advantages and details of the invention are explained in greater detail below and illustrated in the accompanying schematic figures, in which like reference numbers identify like parts throughout.

DESCRIPTION OF THE PREFERRED EMBODIMENTS

Figure 1:
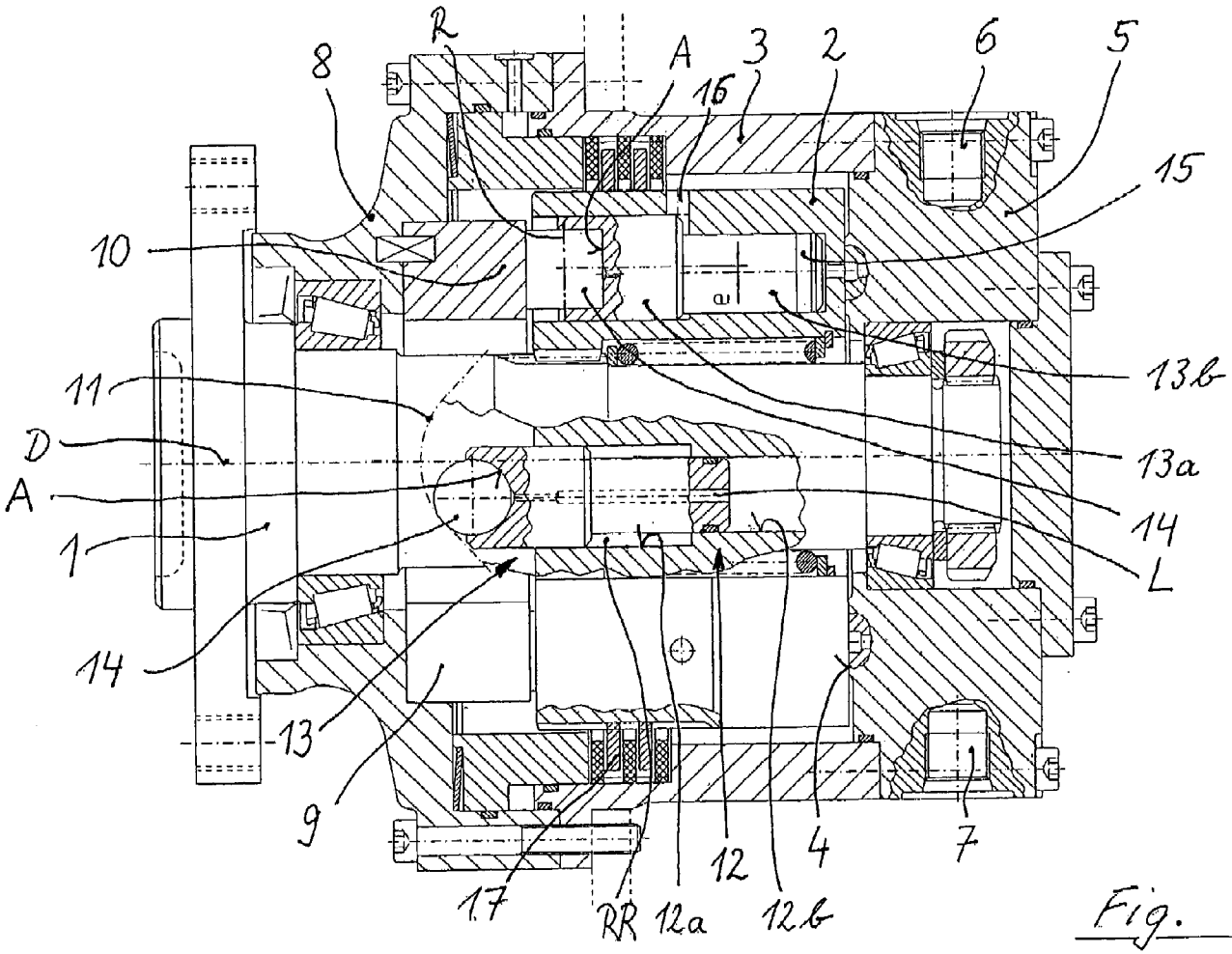
FIG. 1 is a longitudinal section through a first exemplary embodiment of the axial piston machine of the invention.

The multiple-stroke axial piston machine illustrated in FIG. 1 and utilizing a swashplate construction in this exemplary embodiment, is illustrated as a wheel motor and has a drive shaft 1 on which a cylinder drum 2 is mounted. The drive shaft 1 and the cylinder drum 2 are part of a rotor assembly.

The cylinder drum 2 rotates inside a machine housing 3 in rotational synchronization with the drive shaft 1 and is in contact against a control surface 4 that is fixed to the housing and is provided on a control flange 5. In the control flange 5, which also acts as a closing of the machine housing 3, there are connecting borings 6 and 7 for the feed and discharge of hydraulic fluid. The control flange 5 also represents one of two end plates for the mounting of the drive shaft 1 and, thus, of the cylinder drum 2.

A second end plate is formed by a housing cover 8, through which the drive shaft 1 extends. Fastened to the housing cover 8, on the inside, is an eccentric disc 9, which is provided with a plurality of axial cams 10 distributed on the periphery. The axial cams 10 are in a pattern that is impressed on the eccentric disc 9 in the form of a sine wave or in a pattern derived from the sine wave, which is replicated in a track 11 (cam system). The machine housing 3, the control flange 5, and the housing cover 8, plus the eccentric disc 9, are part of a stator assembly.

The cylinder drum 2 is provided with displacement chambers 12 that are distributed on the periphery and are concentric with the axis of rotation D of the drive shaft 1. In each of the displacement chambers, there is a piston-shaped displacement body 13, which can move longitudinally. Each displacement body 13 is supported by a roller 14, which, in this case, is in the form of a cylindrical roller, on the track 11 of the eccentric disc 9. The roller 14 is in an end-side recess A of the displacement body 13. The recess A of the displacement body 13 thereby performs the function of a cage for the roller 14 and, within the framework of the manufacturing tolerances, restricts its movement in the radial and axial direction.

Figure 2:
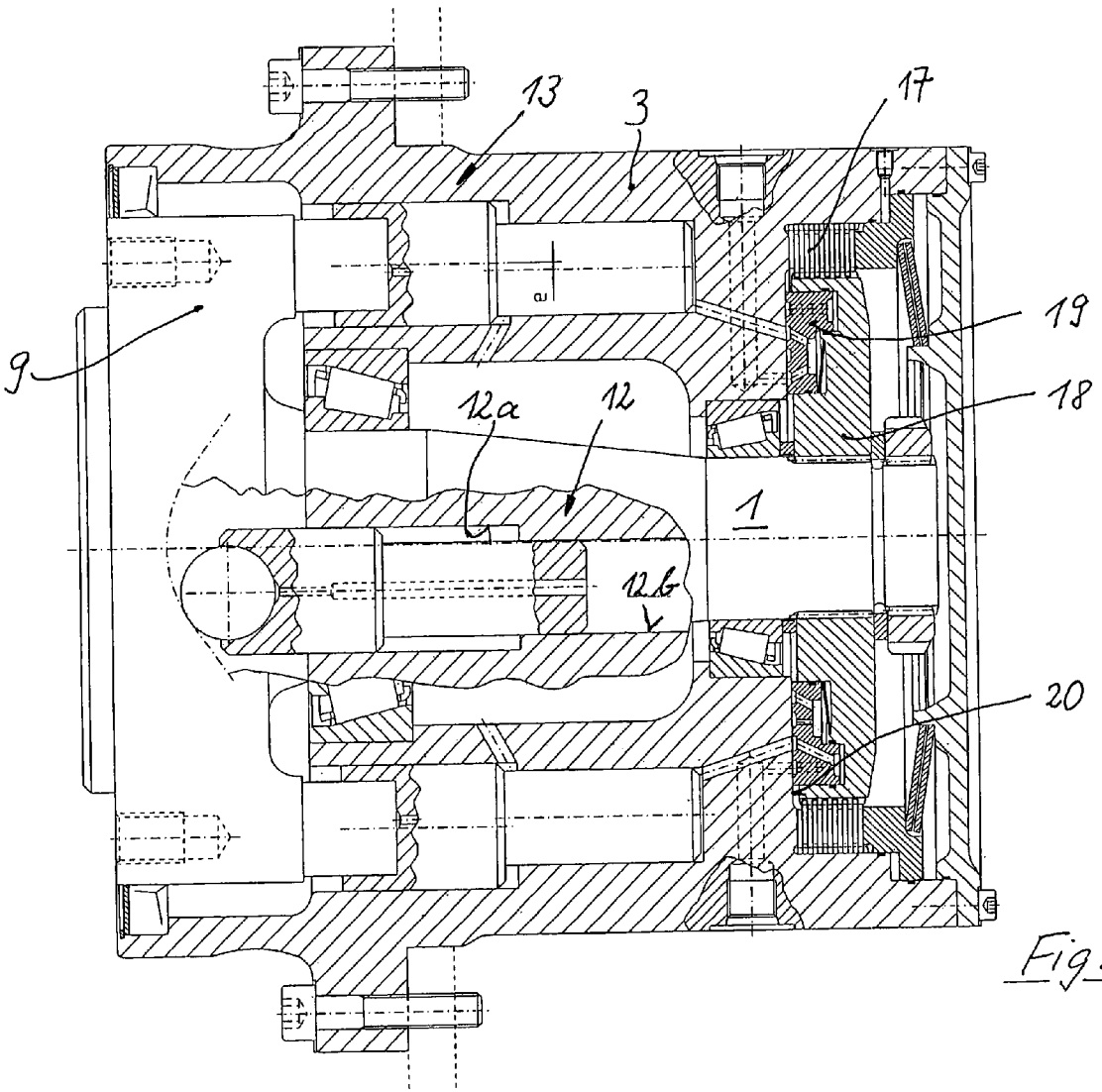
FIG. 2 is a longitudinal section through a second exemplary embodiment of the axial piston machine of the invention.
Figure 3:
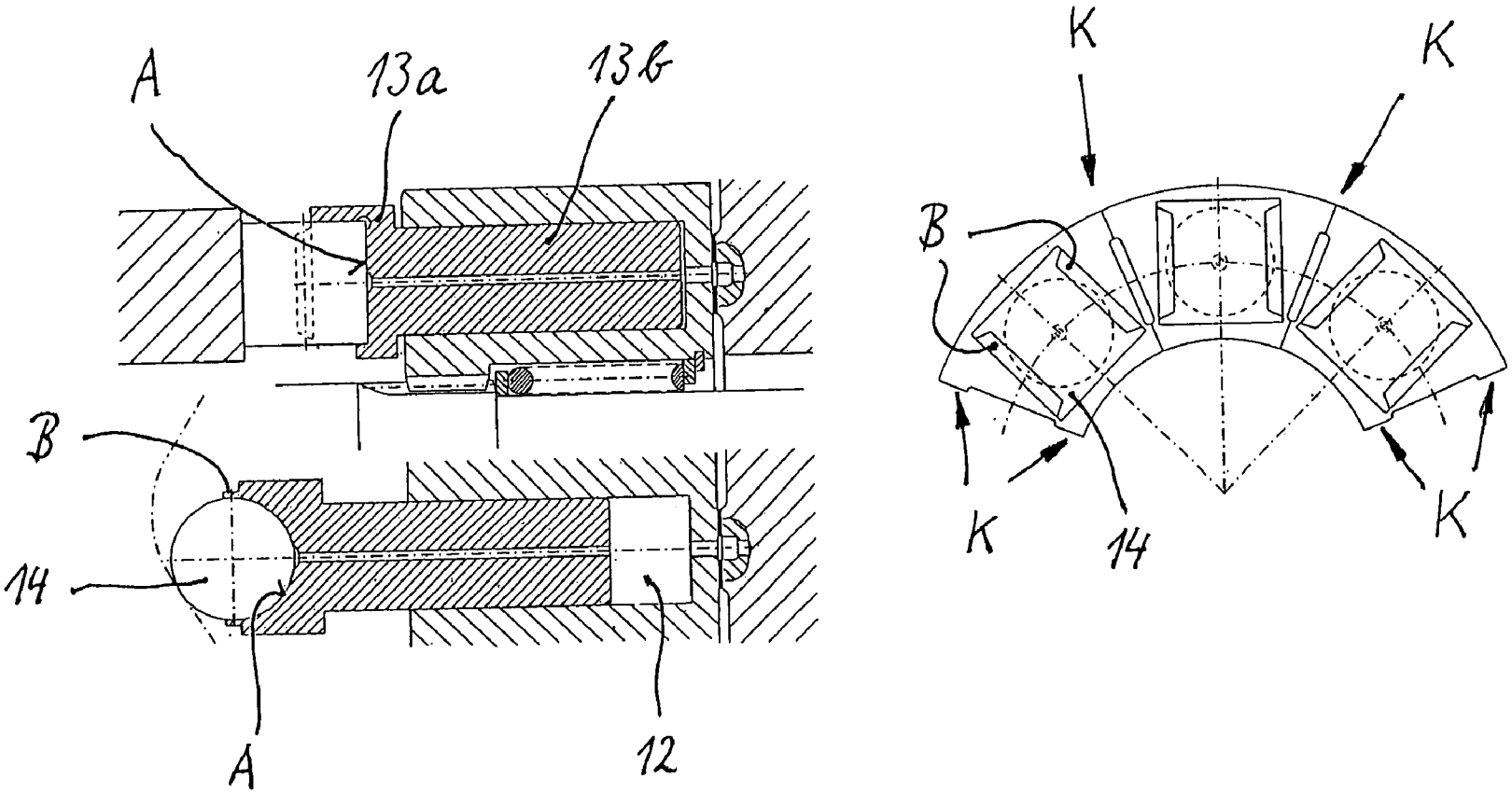
FIG. 3 shows two partial sections of a displacement body and an overhead plan view of the sections.

In FIGS. 2 and 3, the recess A is bounded in both directions (axial and radial) by side walls. It is also possible, however, to omit some or all of the radially inner wall (in relation to the axis of rotation D of the axial piston machine) for manufacturing reasons and to provide a pin or another suitable guide device to secure the roller 14.

The displacement bodies 13 in this exemplary embodiment are in the form of step pistons, with a first piston segment 13*a* and an adjacent second piston segment 13*b* with a smaller diameter. Analogously, the displacement chamber 12 is in the form of a stepped boring and has a first boring segment 12*a*, in which the first piston segment 13*a* of the displacement body 13 is located, and adjacent to it a second boring segment 12*b* with a smaller diameter in which the second piston segment 13*b* of the displacement body 13 is located.

The realization of the displacement body 13 in the form of a step piston first of all has the effect that the ratio of surface area between the end surface (circular or annular surface) of the displacement body 13 that is pressurized with hydraulic fluid inside the displacement chamber 12 and the surface (rectangular surface) on the opposite end surface of the displacement body that functions as a bearing surface for the roller 14 can be selected relatively freely within the available space conditions. It is, therefore, possible to achieve equal surfaces or to take the load off the roller 14 by selecting a larger bearing surface.

In combination with a stepped boring as the displacement chamber 12, the transverse forces introduced by the roller 14 in the first piston segment 13*a* of the displacement body 13 are largely absorbed in the area of the first boring segment 12*a* of the displacement body 12, and, thus, the second piston segment 13*b* and the second boring segment 12*b* are exposed to lower transverse forces and primarily perform a sealing function. To improve the sealing function, the second piston segment 13*b* is provided with a piston ring 15.

As a result of the graduated shape of the displacement body 13 and of the displacement chamber 12, an annular chamber RR is formed between the first boring segment 12*a* and the second piston segment 13*b*. An air vent 16 in the first boring segment 12*a* ensures that the pressure in the annular space RR is largely or substantially equal to the pressure in the interior of the machine housing. During a stroke movement of the displacement body 13, there is neither an underpressure nor an overpressure compared to the pressure in the interior of the housing. Only a flow of hydraulic fluid is produced that flows into the annular space RR or out of the annular space RR.

Because in the illustrated exemplary axial piston machine of the invention the axis of rotation R of the roller 14 is inside the first boring segment 12*a* when the displacement body 13 is plunged into the displacement chamber, under these operating conditions there is only a small bending load on the first piston segment 13*a* of the displacement body 13. Accordingly, the load on the first piston segment 13*a* of the displacement body 13 (like the first boring segment 12*a* of the displacement chamber) is primarily in the form of surface pressure.

In this exemplary embodiment, the second piston segment 13*b* of the displacement body 13 has an offset with respect to the first piston segment 13*a*. As a result of this measure, the displacement body 13 is secured to prevent any twisting relative to the displacement chamber 12. The invention, therefore, prevents the roller from going askew if it (unintentionally) lifts up off the track 11 and prevents it from destroying the track 11 and itself when it comes back into contact with the track 11.

In this context, it is advantageous if the offset (e) is toward the axis of rotation D of the drive shaft 1, so that the outer wall thickness of the cylinder drum 2 is neither reduced nor enlarged.

The roller 14 is hydrostatically relieved by a longitudinal channel L that emerges in the end-surface of the displacement body 13 that can be pressurized by hydraulic fluid to achieve a potential low-friction rolling motion inside the receptacle A. When there is a low load on the roller, however, it is also possible to omit the hydrostatic relief.

A brake 17 is located radially between the cylinder drum 2 and the machine housing 3, which brake 17 is preferably in the form of a hydrostatically-actuatable spring-loaded disc brake. A vehicle that is equipped with hydrostatic axial piston machines as wheel motors can be decelerated by means of the brake 17.

The exemplary embodiment of the axial piston machine illustrated in FIG. 2 is constructed according to the wobble plate principle. In this case, the eccentric disc 9 is connected with the drive shaft 1 in rotational synchronization and, together with it, is part of the rotor assembly. On the other hand, the displacement chambers 12 are machined into the machine housing 3 and are, thus, part of the stator assembly. Here, too (as in the multiple-stroke axial piston machine illustrated in FIG. 1) in the manner of the known art, as a result of the pressurization with hydraulic fluid under operating pressure of the displacement bodies 13 that can move longitudinally into the displacement chambers 12, reciprocating movements of the displacement bodies are produced, which lead to a rotational movement of the rotor assembly relative to the stator assembly (motor operation).

Conversely, as a result of a rotational movement of the rotor assembly relative to the stator assembly, reciprocating movements of the displacement bodies 13 in the displacement chambers 12 are produced and hydraulic fluid is thereby displaced (pump operation).

A disc cam receptacle 18, which is connected in rotational synchronization with the drive shaft 1, carries a disc cam 19, which is in contact against a surface 20 on the machine housing 3. Channels end in the surface 20 that are connected to the displacement chambers 12. In contrast to the axial piston machine that is illustrated in FIG. 1, in this case, therefore, the control surface (molded onto the disc cam 19) rotates with the drive shaft 1. The disc cam 19 is advantageously axially movable and can be pushed by the spring force toward the surface 20, to make possible an automatic adjustment in case of wear.

The brake 7, that is located in the exemplary embodiment illustrated in FIG. 1 radially between the cylinder drum 2 and the machine housing 3, is located in the exemplary embodiment illustrated in FIG. 2 radially between the disc cam receptacle 18 and the machine housing 3.

On the displacement body 13 illustrated in FIG. 3, the first piston segment 13*a* is located outside the displacement chamber 12. The displacement chamber 12 is, therefore, realized in the form of a simple boring, i.e., not in the form of a stepped boring. To prevent the rotation of the displacement bodies 13 in the displacement chambers 12, the first piston segment 13*a* of each displacement body 13 (seen in an overhead view) is in the form of a sector of a circle. In this case, the first piston segments 13*a* of the displacement bodies 13 lie in the peripheral direction with contact areas K against one another and keep one another from rotating in the displacement chambers 12.

FIG. 3 also shows that the roller 14 is held in the recess A of the first piston segment 13*a* by the segments B that overlap the roller equator, which segments are brought into the engagement position by rims or flanges, for example. For manufacturing reasons, the radially inner wall of the recess A is somewhat shorter with respect to the axis of rotation D of the axial piston machine.

Figure 4:
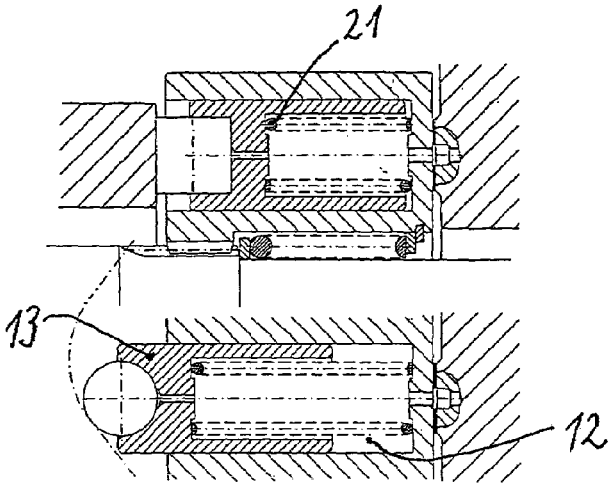
FIG. 4 shows two partial sections through a first displacement body.

On the displacement body 13 illustrated in FIG. 4, the displacement body is realized in the form of a "smooth" (hollow) piston. Consequently, the displacement chamber 12 is a continuous ("smooth") boring, i.e., not a graduated or stepped boring. The piston-shaped displacement body 13 is biased toward the track 11 by a compression spring 21 that acts as a pressure device. Consequently, the roller 14 and the displacement body 13 are always in contact with the track 11. Any lifting up off the track is thereby prevented. This pressure device simultaneously centers the displacement body 13 inside the displacement chamber 12 and, therefore, limits any rotation.

Figure 5:
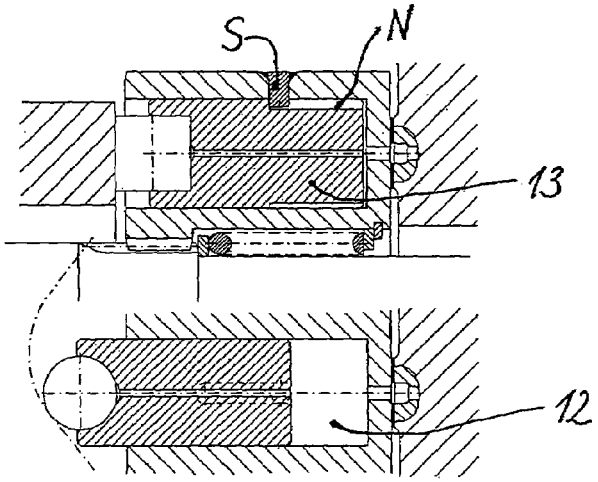
FIG. 5 shows two partial sections through a second displacement body.

The displacement body 13 illustrated in FIG. 5 is realized in the form of a solid piston, which is provided on the external periphery with an axial groove N in which a radial pin S is engaged. The axial groove N, together with the axial pin S, forms a securing device that restricts any rotation of the displacement body 13 relative to the displacement chamber 12.

Figure 6:
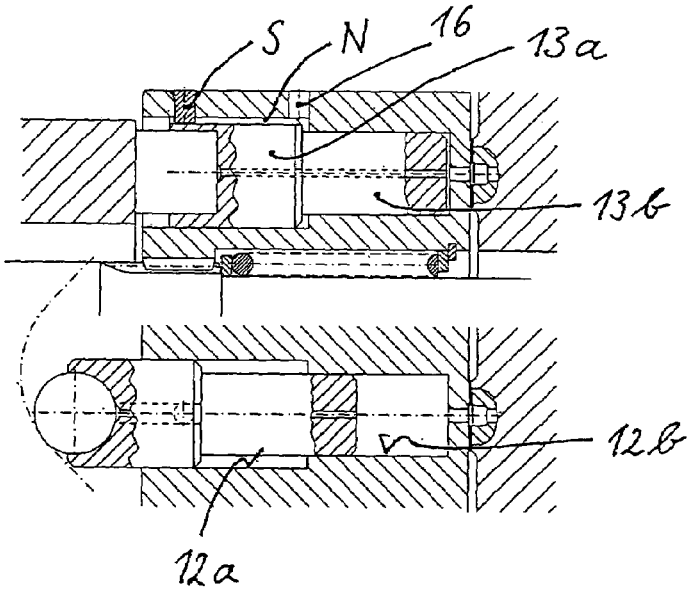
FIG. 6 shows two partial sections through a third displacement body.

On the displacement body 13 illustrated in FIG. 6, which is realized in the form of a step piston, the axial groove N is located in the vicinity of the first piston segment 13*a* and the radial pin S is located in the vicinity of the first boring segment 12*a* of the graduated displacement chamber 12. Of course, the securing devices illustrated in FIGS. 1, 2, 5, and 6 can also be provided with a pressure device to prevent rotation, of the type illustrated in FIG. 4, for example.

Figure 7:
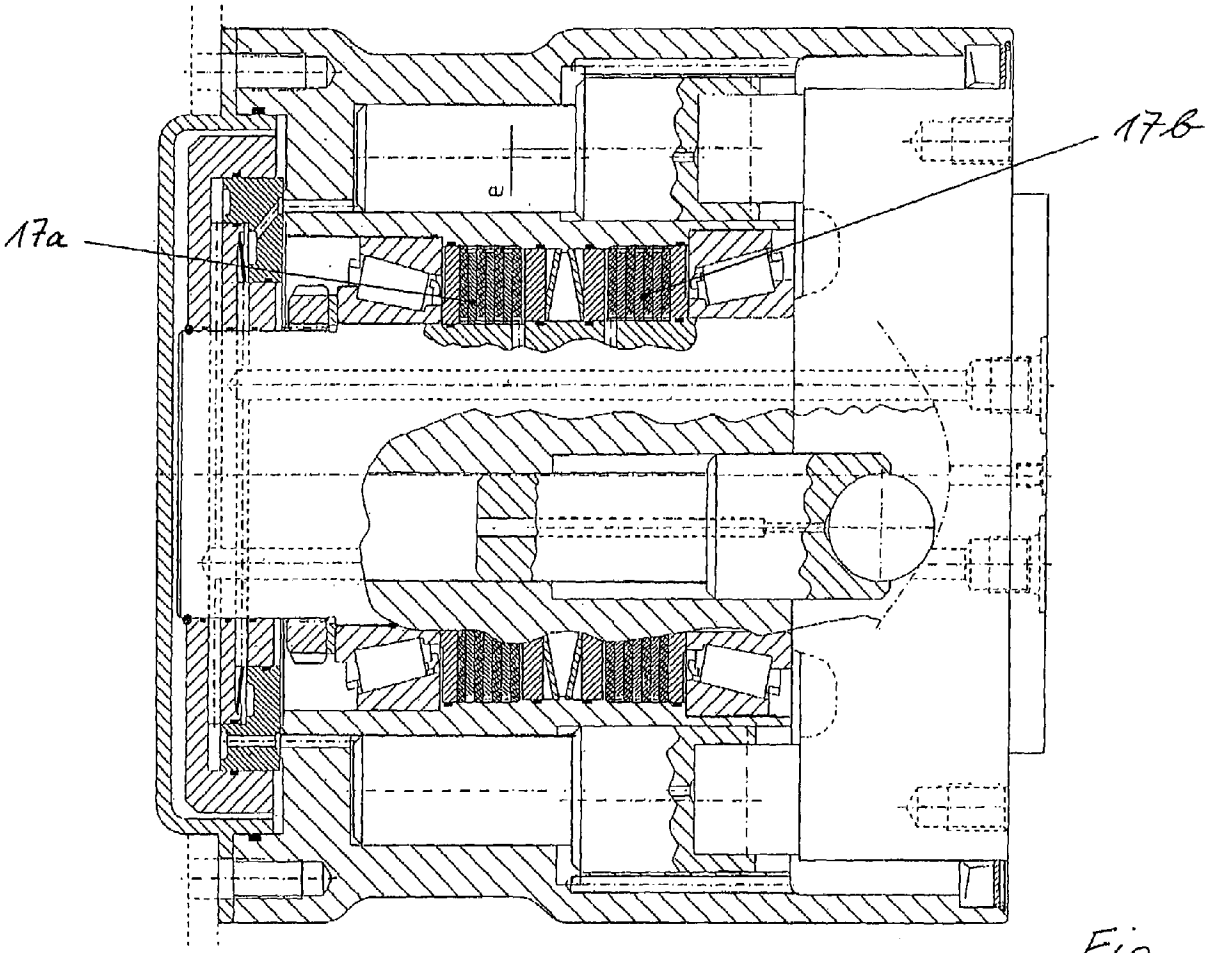
FIG. 7 is a longitudinal section through a third exemplary embodiment of an axial piston machine of the invention.

FIG. 7 shows a variant of the axial piston machine illustrated in FIG. 2. In this embodiment, the brake 17 is located radially between the drive shaft 1 and the machine housing 3, and is divided into two independent brake groups 17*a* and 17*b*, both of which are in the form of hydraulically-actuatable spring-loaded disc brakes and, preferably, each of which has no more than 8-10 discs.

Figure 8:
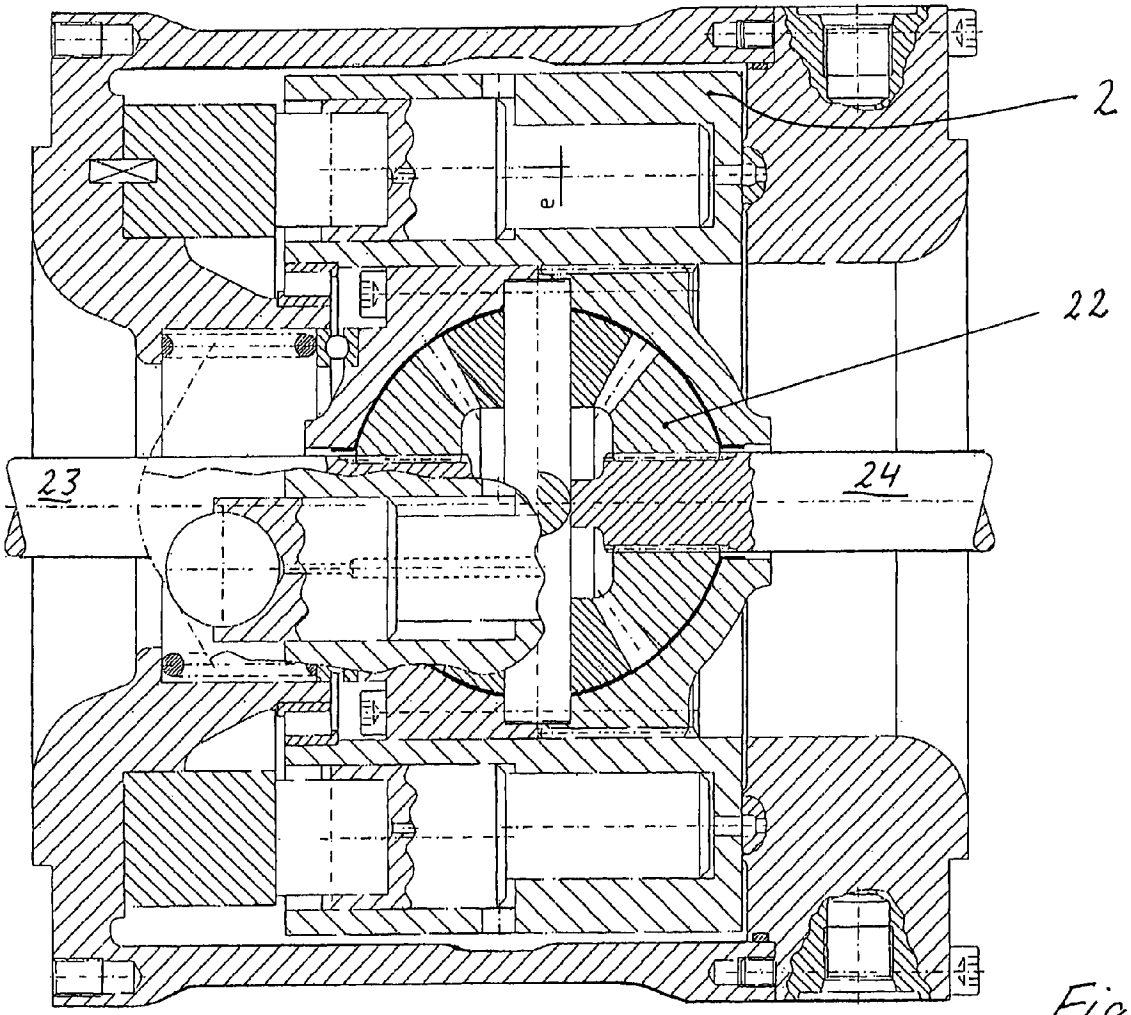
FIG. 8 is a longitudinal section through a fourth exemplary embodiment of an axial piston machine of the invention.
Figure 9:
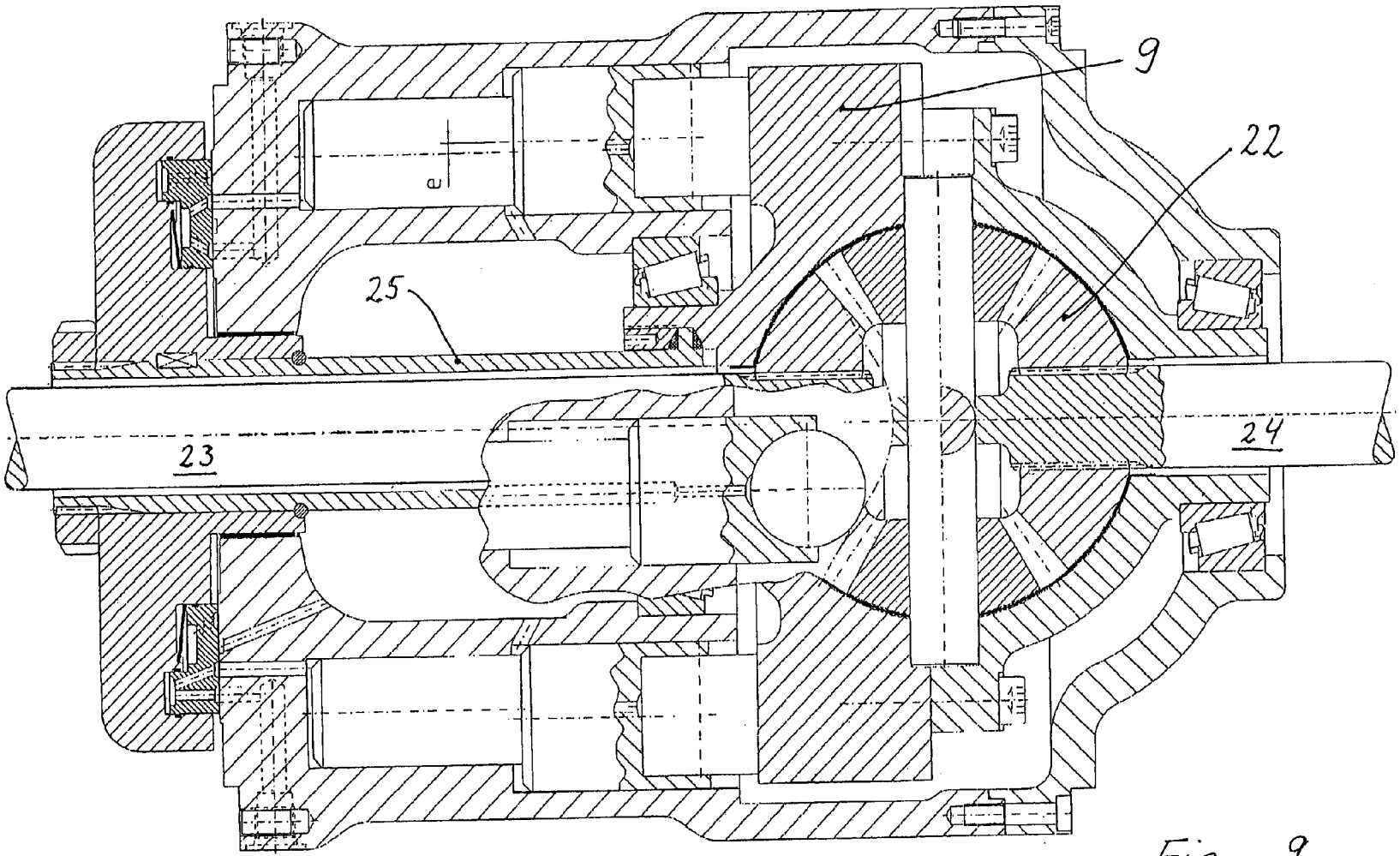
FIG. 9 is a longitudinal section through a fifth exemplary embodiment of an axial piston machine of the invention.

In the exemplary embodiments of the axial piston machine illustrated in FIGS. 8 and 9 that are suitable in particular for use in a drive axle, a differential transmission 22 is integrated into the rotor assembly and can be, for example, in the form of a bevel gear differential. In this case, the differential transmission 22 is located radially and axially inside the cylinder drum 2 of the axial piston machine utilizing the swashplate principle (see FIG. 8). If the axial piston machine is realized utilizing the wobble plate principle, i.e., if it has a rotating eccentric disc 9 (see FIG. 9), the eccentric disc 9 (as illustrated) can take over the function of one-half of a differential cage or can be in another type of drive connection with the differential transmission 22.

In each case, two output shafts 23 and 24 are extended on both sides out of the axial machine. In the axial piston machine illustrated in FIG. 9, one of the output shafts 23 is extended through a hollow control shaft 25.

Of course, a brake can also be provided on the axial piston machine illustrated in FIGS. 8 and 9, as described above with reference to FIGS. 1, 2, and 7.

Figure 10:
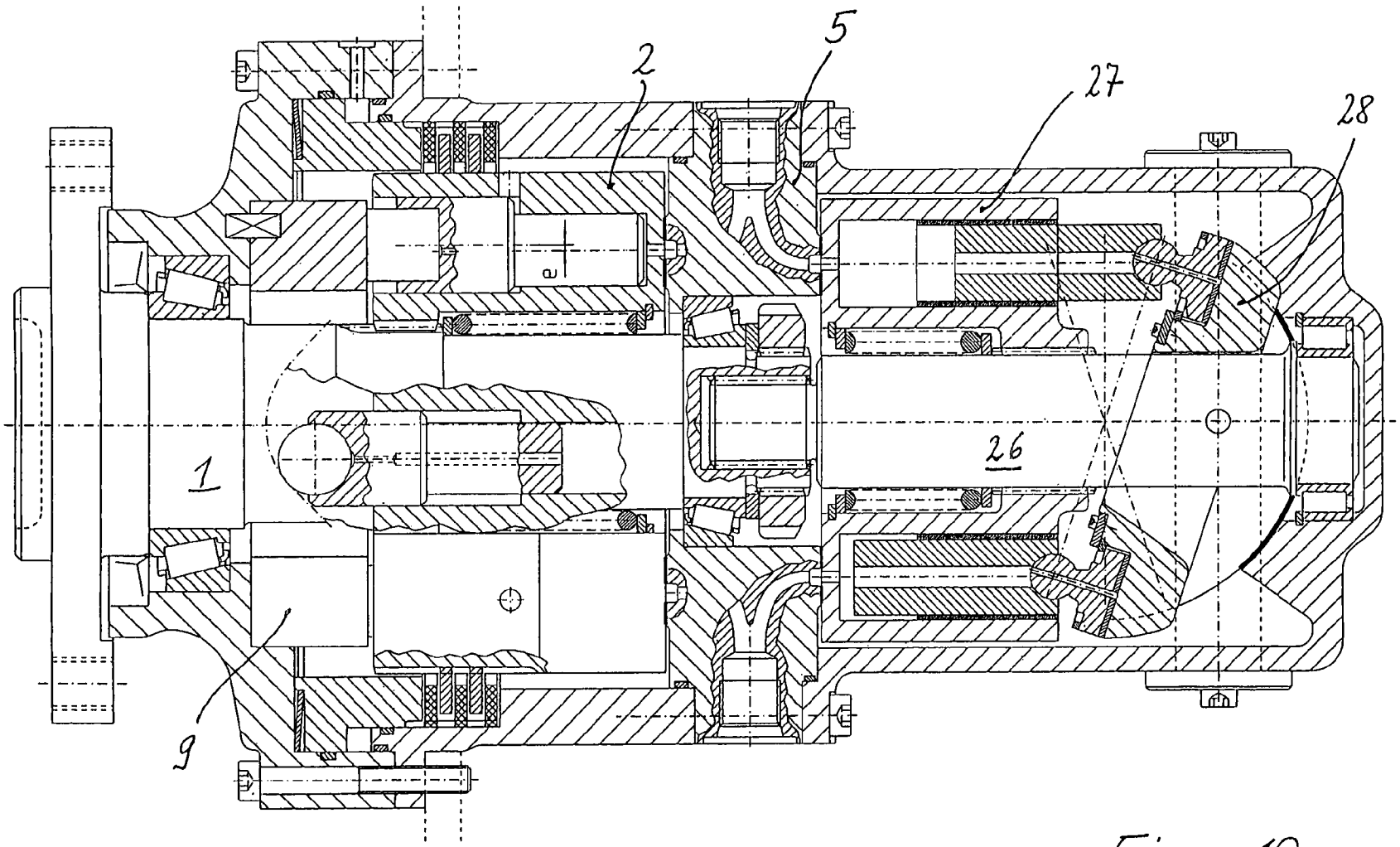
FIG. 10 is a longitudinal section through a sixth exemplary embodiment of an axial piston machine of the invention.

On the axial piston machine illustrated in FIG. 10, which corresponds in principle to the machine illustrated in FIG. 1 (swashplate construction), the drive shaft 1 and, thus, the rotor assembly is rotationally synchronously coupled with a drive shaft 26 of a second axial piston machine. The second axial piston machine is in the form of an adjustable axial piston machine utilizing the swashplate construction and is hydraulically connected in parallel with the first axial piston machine. A cylinder drum 27, which is in contact against a common control flange 5 of the two axial piston machines, rotates with the drive shaft 26. On the axial end opposite the eccentric disc 9 of the module that is formed by the two axial piston machines, there is a pivoting eccentric disc 28 of the second axial piston machine.

By pivoting the eccentric disc 28, the delivery and intake volume of the adjustable axial piston machine can be varied and, thus, also the total delivery or total intake volume of the module incorporating the two axial piston machines can also be varied. When the module is used as a motor, the output speed and the output torque are thereby variable. The delivery volume of a pump that feeds the motor can thereby be reduced as a result of the secondary regulation that therefore becomes possible.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A multiple-stroke hydrostatic axial piston machine comprising:

a plurality of piston-shaped displacement bodies each longitudinally movable in a displacement chamber, wherein the displacement bodies are supported by a roller body on a track that is provided with axial cams that generate a reciprocal motion, wherein each of the roller bodies is a roller which is located in a recess of the displacement body that restricts radial and axial relative movements of the roller with respect to the displacement body, wherein the displacement body is in the form of a cage of the roller, wherein the roller is a cylindrical or barrel roller, and wherein the displacement body has a first piston segment that holds the roller and a second hydraulically pressurizable piston segment with a smaller diameter than that of the first piston segment.

2. The multiple-stroke hydrostatic axial piston machine as claimed in claim 1, wherein the first and second piston segments of the displacement body are located one immediately behind the other.

3. The multiple-stroke hydrostatic axial piston machine as claimed in claim 1, wherein the first piston segment is located in a first boring segment of an associated displacement chamber, which first boring segment is provided for the absorption of transverse forces, and the second piston segment projects into a second boring segment of the displacement chamber that contains hydraulic fluid.

4. The multiple-stroke hydrostatic axial piston machine as claimed in claim 3, wherein the first boring segment of the displacement chamber is connected to an air vent.

5. The multiple-stroke hydrostatic axial piston machine as claimed in claim 3, wherein an axis of rotation of the roller is located inside the first boring segment of the displacement chamber, at least when it is in contact with a camshaft of axial cams.

6. The multiple-stroke hydrostatic axial piston machine as claimed in claim 1, wherein the first piston segment is located outside the displacement chamber.

7. The multiple-stroke hydrostatic axial piston machine as claimed in claim 1, wherein the track is provided on a stator assembly and displacement chambers are provided in a cylinder drum of a rotor assembly that is in axial contact against a control surface of the stator assembly that is fixed to the housing.

8. The multiple-stroke hydrostatic axial piston machine as claimed in claim 1, wherein the track is provided on an eccentric disc of a rotor assembly and displacement chambers are provided in a machine housing of a stator assembly.

9. The multiple-stroke hydrostatic axial piston machine as claimed in claim 8, including a disc cam that rotates in synchronization with a drive shaft of the rotor assembly, and is located so that it can move axially in a disc cam receptacle that is connected with the drive shaft and is in contact against a surface of the stator assembly.

10. A multiple-stroke hydrostatic axial piston machine comprising:

a plurality of piston-shaped displacement bodies each longitudinally movable in a displacement chamber, wherein the displacement bodies are supported by a roller body on a track that is provided with axial cams that generate a reciprocal motion, wherein each of the roller bodies is a roller which is located in a recess of the displacement body that restricts radial and axial relative movements of the roller with respect to the displacement body, and wherein the displacement body is in the form of a cage of the roller; and a pressure device that is independent of the operating pressure and provided to generate a force that pushes at least one of the displacement bodies toward the track and holds the roller in engagement with the track.

11. The multiple-stroke hydrostatic axial piston machine as claimed in claim 10, wherein the pressure device includes a compression spring that acts directly or indirectly on the displacement body.

12. A multiple-stroke hydrostatic axial piston machine comprising:

a plurality of piston-shaped displacement bodies each longitudinally movable in a displacement chamber, wherein the displacement bodies are supported by a roller body on a track that that is provided with axial cams that generate a reciprocal motion, wherein each of the roller bodies is a roller which is located in a recess of the displacement body that restricts radial and axial relative movements of the roller with respect to the displacement body, and wherein the displacement body is in the form of a cage of the roller; and a securing device to limit rotation of the displacement body relative to an associated displacement chamber.

13. The multiple-stroke hydrostatic axial piston machine as claimed in claim 12, wherein the securing device includes a radial pin which projects into an axial groove that is machined into an outer periphery of the displacement body.

14. The multiple-stroke hydrostatic axial piston machine as claimed in claim 13, wherein the displacement body has a first piston segment that holds the roller and a second hydraulically pressurizable piston segment with a smaller diameter than that of the first piston segment, wherein the first piston segment is located in a first boring segment of an associated displacement chamber, which first boring segment is provided for the absorption of transverse forces, wherein the second piston segment projects into a second boring segment of the displacement chamber that contains hydraulic fluid, and wherein the axial groove is provided on the first piston segment of the displacement body.

15. The multiple-stroke hydrostatic axial piston machine as claimed in claim 12, wherein the displacement body has a first piston segment that holds the roller and a second hydraulically pressurizable piston segment with a smaller diameter than that of the first piston segment, wherein the first piston segment is located in a first boring segment of an associated displacement chamber, which first boring segment is provided for the absorption of transverse forces, wherein the second piston segment projects into a second boring segment of the displacement chamber that contains hydraulic fluid, and wherein the second piston segment has an offset with respect to the first piston segment.

16. The multiple-stroke hydrostatic axial piston machine as claimed in claim 12, wherein the displacement body has a first piston segment that holds the roller and a second hydraulically pressurizable piston segment with a smaller diameter than that of the first piston segment, wherein the first piston segment is located outside the displacement chamber, and wherein the first piston segment has contact areas in the peripheral direction that are in engagement with contact areas of the first piston segments of the neighboring displacement bodies and act together as a securing device to restrict the rotation of the displacement body relative to the displacement chamber.

17. A multiple-stroke hydrostatic axial piston machine comprising:

a plurality of piston-shaped displacement bodies each longitudinally movable in a displacement chamber, wherein the displacement bodies are supported by a roller body on a track that is provided with axial cams that generate a reciprocal motion, wherein each of the roller bodies is a roller which is located in a recess of the displacement body that restricts radial and axial relative movements of the roller with respect to the displacement body, wherein the displacement body is in the form of a cage of the roller, wherein the track is provided on a stator assembly and displacement chambers are provided in a cylinder drum of a rotor assembly that is in axial contact against a control surface of the stator assembly that is fixed to the housing, and wherein the displacement body has a first piston segment that holds the roller and a second hydraulically pressurizable piston segment with a smaller diameter than that of the first piston segment, wherein the first piston segment is located in a first boring segment of an associated displacement chamber, which first boring segment is provided for the absorption of transverse forces, wherein the second piston segment projects into a second boring segment of the displacement chamber that contains hydraulic fluid, and wherein the second piston segment and the second boring segment are offset in relation to the first piston segment and the first piston segment respectively radially inwardly with respect to the axis of rotation of the cylinder drum.

18. A multiple-stroke hydrostatic axial piston machine comprising:

a plurality of piston-shaped displacement bodies each longitudinally movable in a displacement chamber, wherein the displacement bodies are supported by a roller body on a track that is provided with axial cams that generate a reciprocal motion, wherein each of the roller bodies is a roller which is located in a recess of the displacement body that restricts radial and axial relative movements of the roller with respect to the displacement body, wherein the displacement body is in the form of a cage of the roller, and wherein the track is provided on a stator assembly and displacement chambers are provided in a cylinder drum of a rotor assembly that is in axial contact against a control surface of the stator assembly that is fixed to the housing; and a brake located radially between the cylinder drum and a surrounding machine housing.

19. The multiple-stroke hydrostatic axial piston machine as claimed in claim 18, wherein the brake is a spring-loaded disc brake comprising at least two independent brake groups.

20. A multiple-stroke hydrostatic axial piston machine comprising:

a plurality of piston-shaped displacement bodies each longitudinally movable in a displacement chamber, wherein the displacement bodies are supported by a roller body on a track that is provided with axial cams that generate a reciprocal motion, wherein each of the roller bodies is a roller which is located in a recess of the displacement body that restricts radial and axial relative movements of the roller with respect to the displacement body, wherein the displacement body is in the form of a cage of the roller, and wherein the track is provided on an eccentric disc of a rotor assembly and displacement displacement chambers are provided in a machine housing of a stator assembly; and a disc cam that rotates in synchronization with a drive shaft of the rotor assembly, and is located so that it can move axially in a disc cam receptacle that is connected with the drive shaft and is in contact against a surface of the stator assembly; and a brake located radially between a disc cam receptacle and the machine housing.

21. The multiple-stroke hydrostatic axial piston machine as claimed in claim 20, wherein the brake is a spring-loaded disc brake comprising at least two independent brake groups.

22. A multiple-stroke hydrostatic axial piston machine comprising:

a plurality of piston-shaped displacement bodies each longitudinally movable in a displacement chamber, wherein the displacement bodies are supported by a roller body on a track that is provided with axial cams that generate a reciprocal motion, wherein each of the roller bodies is a roller which is located in a recess of the displacement body that restricts radial and axial relative movements of the roller with respect to the displacement body, wherein the displacement body is in the form of a cage of the roller, and wherein the track is provided on an eccentric disc of a rotor assembly and displacement chambers are provided in a machine housing of a stator assembly;

a disc cam that rotates in synchronization with a drive shaft of the rotor assembly, and is located so that it can move axially in a disc cam receptacle that is connected with the drive shaft and is in contact against a surface of the stator assembly; and a brake located radially between the drive shaft and the machine housing.

23. The multiple-stroke hydrostatic axial piston machine as claimed in claim 22, wherein the brake is a spring-loaded disc brake comprising at least two independent brake groups.

24. A multiple-stroke hydrostatic axial piston machine comprising:

a plurality of piston-shaped displacement bodies each longitudinally movable in a displacement chamber, wherein the displacement bodies are supported by a roller body on a track that is provided with axial cams that generate a reciprocal motion, wherein each of the roller bodies is a roller which is located in a recess of the displacement body that restricts radial and axial relative movements of the roller with respect to the displacement body, wherein the displacement body is in the form of a cage of the roller, wherein the track is provided on a stator assembly and displacement chambers are provided in a cylinder drum of a rotor assembly that is in axial contact against a control surface of the stator assembly that is fixed to the housing, and wherein the rotor assembly has a differential transmission.

25. A multiple-stroke hydrostatic axial piston machine comprising:

a plurality of piston-shaped displacement bodies each longitudinally movable in a displacement chamber, wherein the displacement bodies are supported by a roller body on a track that is provided with axial cams that generate a reciprocal motion, wherein each of the roller bodies is a roller which is located in a recess of the displacement body that restricts radial and axial relative movements of the roller with respect to the displacement body.

wherein the displacement body is in the form of a cage of the roller, wherein the track is provided on a stator assembly and displacement chambers are provided in a cylinder drum of a rotor assembly that is in axial contact against a control surface of the stator assembly that is fixed to the housing, and wherein the rotor assembly is rotationally synchronously coupled with a rotor assembly of a second axial piston machine having a swashplate, and wherein the second axial piston machine has an adjustable stroke volume and is connected hydraulically in parallel.

26. The multiple-stroke hydrostatic axial piston machine as claimed in claim 25, wherein eccentric discs of the two axial piston machines that form a module are located on opposite ends of the module, with a common control flange located between the two axial piston machines.

* * * * *

UNITED STATES PATENT AND TRADEMARK OFFICE

CERTIFICATE OF CORRECTION

PATENT NO. : 7,331,272 B2
APPLICATION NO. : 11/361712
DATED : February 19, 2008
INVENTOR(S) : Franz Forster It is certified that error appears in the above-identified patent and that said Letters Patent is hereby corrected as shown below:

Column 10, Line 45, Claim 12, “that that is provided” should read
-- that is provided --

Column 12, Line 28, Claim 20, “displacement displacement” should read
-- displacement --

Signed and Sealed this

Eighth Day of July, 2008

JON W. DUDAS
*Director of the United States Patent and Trademark Office*